United States Patent [19]

Turner, Jr.

[11] 4,001,955

[45] Jan. 11, 1977

[54] MUDGUARD STYLE SHOE CONSTRUCTION

[75] Inventor: Newton C. Turner, Jr., Nashville, Tenn.

[73] Assignee: Genesco, Inc., Nashville, Tenn.

[22] Filed: Oct. 28, 1975

[21] Appl. No.: 620,873

[52] U.S. Cl. ..... 36/96; 36/108

[51] Int. Cl.[2] ..... A43B 7/14; A43B 23/00

[58] Field of Search ..... 12/142 R, 142 A, 142 B, 12/145; 36/83, 96, 99, 108, 11, 45

[56] References Cited

UNITED STATES PATENTS

| | | | |
|---|---|---|---|
| 2,014,094 | 9/1935 | Wiggin | 36/11 |
| 2,322,297 | 6/1943 | Jalbert | 36/108 |
| 3,832,793 | 9/1974 | Siskin | 36/83 |
| 3,938,265 | 2/1976 | Probstl et al. | 36/11 |

*Primary Examiner*—Patrick D. Lawson

*Attorney, Agent, or Firm*—Harrington A. Lackey

[57] ABSTRACT

A shoe construction including an upper member preferably divided into two pieces, an upper and a mudguard piece in which the mudguard piece has a pair of depending side portions extending beneath the upper and joined along longitudinal abutting edges between the heel portion and the forepart of the upper member.

The method of making this shoe includes slip-lasting the upper member after the upper and the mudguard piece have been secured together, and after the bottom edges of the mudguard piece have been secured. Thus, lasting is facilitated, because only the forepart and heel portions of the upper member need be lasted. Moreover, less attention is required for fitting the upper member about the last since the shape and fit has been substantially determined by pre-securing the bottom edges of the depending mudguard side portions.

5 Claims, 6 Drawing Figures

MUDGUARD STYLE SHOE CONSTRUCTION

BACKGROUND OF THE INVENTION

This invention relates to a shoe construction method, and more particularly to an improved method of lasting a shoe.

Heretofore, the lasting of the shoe upper to the insole required considerable care in evenly pulling the bottom marginal edges of the upper, throughout its length, and securing the marginal edges to the entire length of the insole and still maintain the proper fit of the upper upon the last. Undue tension or slack at any one or more points along the lower marginal edges, when the edges are secured by stitching, stapling or gluing to the insole, would create distortion in the shoe at those points.

Usually, the upper is lasted or secured to the insole in different stages, at different times and by different pieces of machinery, or by hand, and by different personnel. Thus, normally, the forepart of the upper is secured or lasted to the forepart of the insole in one operation, such as by stitching and/or securing by adhesives. In a separate operation, the side portions of the upper are side lasted by stitching, stapling or adhesive to the shank portion of the insole, and in another operation, the heel portions are heel-lasted to the back part of the insole.

Therefore, the securing of the upper to the insole requires a considerable degree of care, not only in the various stages of lasting the various marginal portions of the upper to specific portions of the insole, but also in the cutting, stitching, assembly and marking of the parts of the upper prior to lasting.

SUMMARY OF THE INVENTION

It is therefore an object of this invention to provide a shoe construction and method in which certain marginal portions of the upper member are extended in depth and pre-secured by stitching so that the upper member is substantially pre-fitted prior to slip-lasting.

More specifically, the construction and method contemplated by this invention includes extending the side portions of the upper member so that the bottom edges of the side portions will extend around the bottom of the shoe or last and be presecured, specifically pre-stitched, along a longitudinal line joining the bottom edges between the forepart and the heel portion of the upper, prior to insertion of the last.

Furthermore, the forepart lower marginal area of the upper member is formed into a depending rim piece, more specifically, a separate stitched rim portion, which presents a "cup-shaped" pocket for receiving the forepart of the last.

With the side portions pre-stitched and the rim portion pre-formed, only the forepart and the heel portion marginal edges of the upper member need be lasted prior to the application of the outsole and the heel.

Furthermore, because the pre-stitched side portions of the upper member extend around the bottom of the shoe, the outsole need not cover the intermediate portion of the upper member, but only the forepart of the upper member and the insole.

In the preferred method, the upper member is formed in two discrete parts, namely, the upper having lower intermediate and forepart marginal edges higher than the marginal edge of the heel portion and a mudguard piece coextensive with the side or intermediate portions and the forepart portion of the upper. The mudguard piece has a top edge portion adapted to overlap and be secured, preferably by stitching, to the lower portion of the intermediate and forepart portions of the upper. The bottom marginal edge of the mudguard piece in the forepart area is adapted to project below and contain the forepart insole, when in place, and is adapted to be folded over and lasted to the forepart insole.

However, the intermediate or shank portion of the mudguard piece is of sufficiently great depth to project substantially below the upper and extend around the shoe shank, so that its bottom edges may be joined along a longitudinal center line by stitching prior to slip-lasting. The mudguard piece is pre-cut so that its bottom marginal edges, when abutted and stitched, will fit snugly against the bottom of the last and pull with sufficient pressure against the other parts of the mudguard piece and the upper, to which the mudguard piece is stitched, to create a snug and uniform fit of the upper member about the last.

Thus, the forepart of the upper member, specifically the forepart of the mudguard piece, and the heel portions of the upper can be more easily, and accurately lasted with a minimum of effort and pressure, because of the pre-fitting of the upper member and particularly the prefabrication of the mudguard piece.

After the upper member has been pre-stitched, slip-lasted, toe-lasted and heel-lasted, the outsole and heel may then be applied in a conventional manner. However, the outsole may be limited in size to merely cover the forepart of the shoe since the outsole need not cover the portion of the mudguard piece extending around the arch area of the shoe.

The insole is formed in two pieces, a forepart insole and a backpart insole. the forepart insole is fitted, in the forepart of the upper, and the backpart insole, or shank member, extends against the inner surface of the pre-formed shank portion of the mudguard piece and projects into the heel portion to provide rigidity of the shoe between the heel and the outsole.

DESCRIPTION OF THE PREFERRED EMBODIMENT

Figure 6:
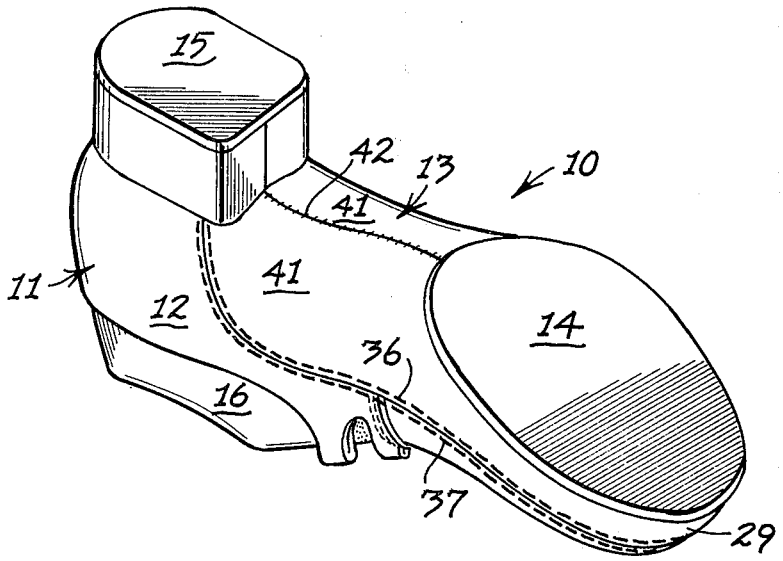
FIG. 6 is a bottom perspective view of the completed shoe, still mounted upon the last.

Referring now to the drawings in more detail, the shoe 10 disclosed in FIG. 6 basically includes an upper member 11 including an assembly of a shoe upper 12 and a mudguard piece 13, a forepart outsole 14 and a heel 15, mounted upon a shoe last 16.

Figure 1:
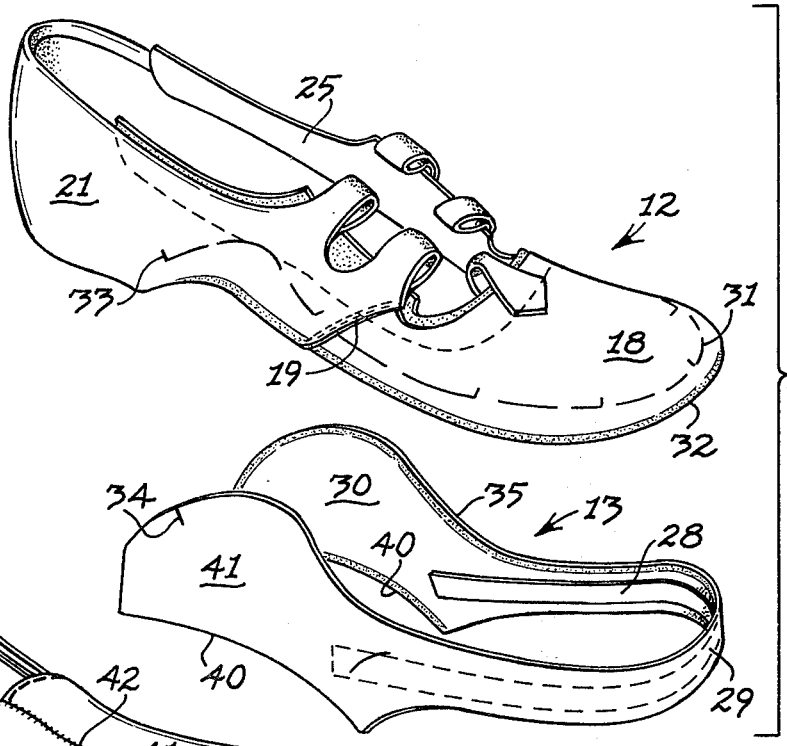
FIG. 1 is a top front, perspective, exploded view of the completed upper and the mudguard piece prior to assembly.

In the manufacture of the shoe 10, the pieces of the upper 12 are first cut out in the desired patterns and stitched together in a conventional manner, as disclosed in FIG. 1.

In FIG. 1, the upper 12 includes a vamp 18 secured by stitching 19 and 20 to the quarters 21 and 22, respectively. The rear edges of the quarters 21 and 22 are secured by the line of stitching 23, which also secures the counter pocket 24 holding the counter, concealed in the drawings. A lining 25 may also be stitched along the upper margins of the upper 12, portions 26 of which are trimmed out in subsequent stages of the process.

The mudguard piece 13 is also cut to the desired shape, as disclosed in FIG. 1, and reinforced by a length of "Nylon" or glass tape 28 along the interior of the forepart or rim portion or piece 29 of the mudguard piece 13. The mudguard piece 13 may also be lined with a doubler or liner 30.

A line of stitch marks 31 is drawn on the upper surface of the upper 12 along a course spaced above the lower marginal edge 32 of the upper and terminating in stop marks 33. The mudguard piece 13 is also provided with corresponding stop stitch marks 34.

The top marginal edge 35 of the mudguard piece 13 is then laid along the stitch marks 31 on the upper 12 so that the upper portion of the mudguard piece 13 overlays the lower marginal forepart and intermediate portions of the upper 12, with the stop stitch marks 33 and 34 in registry on both sides of the upper 12.

Figure 2:
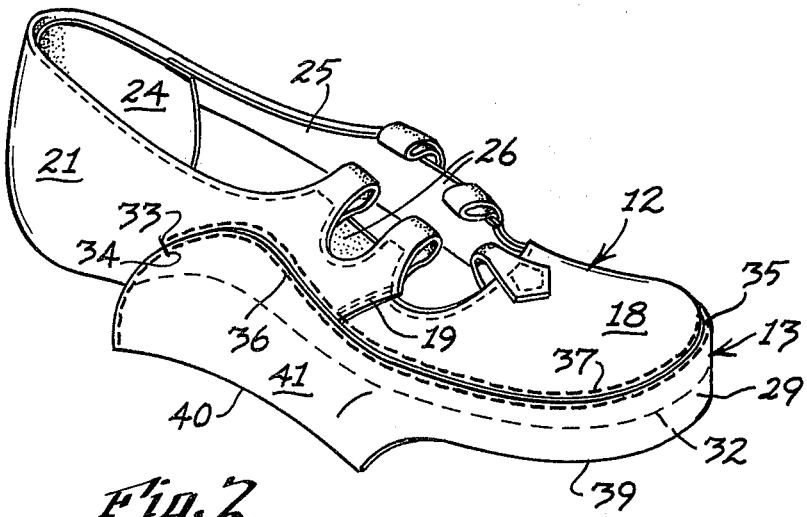
FIG. 2 is a view similar to FIG. 1 in which the mudguard piece has been stitched to the upper.

As disclosed in FIG. 2, a lower line of stitching 36 is sewn between the stop stitch marks 33 and 34 and along the top edge of the mudguard piece 13. A second line of stitching 37 is sewn parallel to the stitch line 36 but only on the upper 12 for a decorative effect, as best disclosed in FIG. 2.

As best disclosed in FIG. 2, the upper portion of the mudguard piece 13 overlaps the lower margin of the upper 12 as indicated by the location of the bottom marginal edge 32 of the upper 12 in hidden lines in FIG. 2. Spaced below the bottom marginal edge 32 of the upper 12 is the forepart marginal edge 39 of the forepart or rim piece 29.

In a preferred form of the method, the underlapping portion of the vamp between the stitch line 36 and the lower marginal edge 32 is cemented by approprite shoe adhesive to the overlapping portion of the rim piece 29.

Depending below the forepart marginal edge 39 are the elongated mating bottom edges 40 of the side or shank flaps 41 forming the intermediate or side portions of the mudguard piece 13.

Figure 3:
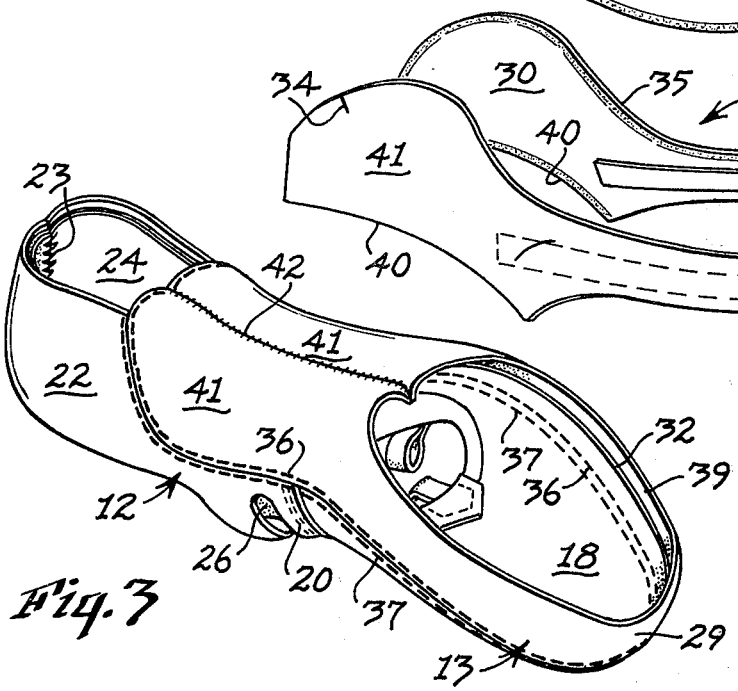
FIG. 3 is a bottom perspective view of the upper member assembly in which the bottom marginal edges of the mudguard piece have been stitched together.

As best disclosed in FIG. 3, the elongated bottom edges 40 are joined along their entire length beneath the shoe by the line of stitching 42.

Prior to lasting, two coats of a former composition are applied to the interior of the toe area of the vamp 18.

Figure 4:
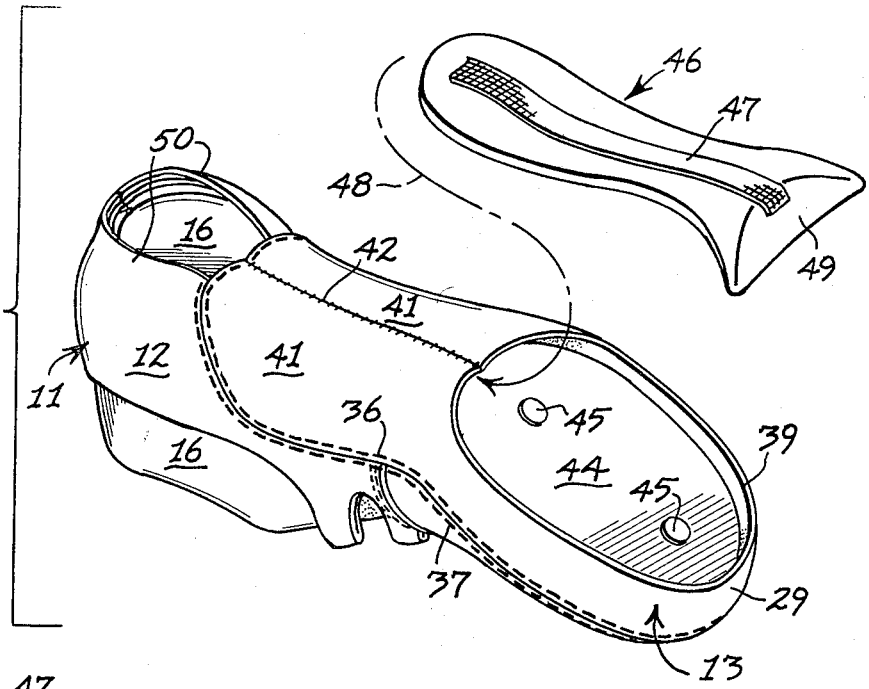
FIG. 4 is a view similar to FIG. 3, showing the step of slip-lasting, just prior to the insertion of the pre-molded shank member.

Referring now to FIG. 4, a forepart or tap insole of any convenient material 44 is secured to the corresponding forepart of a last 16 by tacks 45.

The counter within the counter pocket 24 is activated by heat in a conventional manner, and then the last 16 is inserted into the pocket formed by the asembled upper member 11 until the last 16 is received within the upper member 11 in the properly fitted position disclosed in FIG. 4.

A backpart insole in the form of a pre-molded shank member 46 of rigid plastic material, in which is embedded an elongated metal reinforcing member 47, is inserted beneath the stitched flaps 41 as shown by the arrows 48 in FIG. 4. Prior to insertion of the shank member 46, the ball area 49 is pre-dipped in a shoe cement for securing to the rear edge portion of the forepart insole 44 in its position disclosed in FIG. 5.

When the last 16 is inserted into the upper member assembly 11, the operator checks to see that the toe is properly centered and that the bottom edge portion 32 of the vamp 18 registers with the bottom edge of the forepart insole 44. When these edges are aligned, then the last 16 is "snapped into position.

Figure 5:
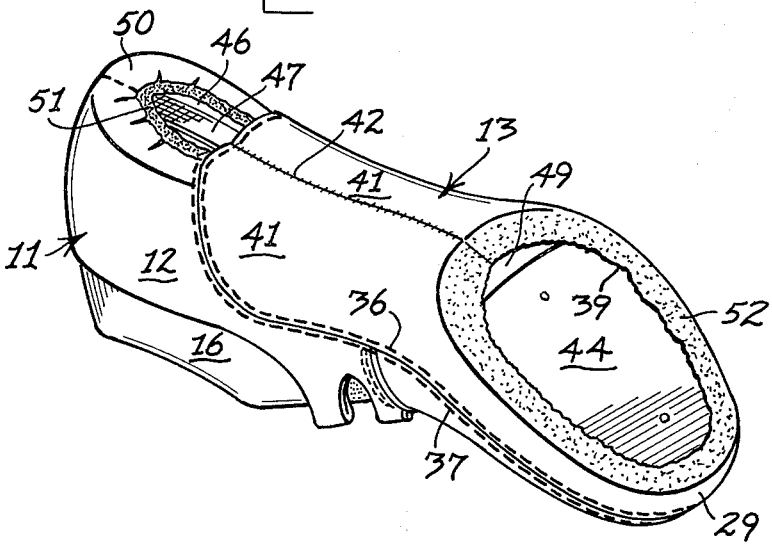
FIG. 5 is a view similar to FIG. 4, after the steps of toe-lasting and heel-lasting.

The shank member 46 is moved rearwardly beneath the flaps 41, as disclosed in FIGS. 4 and 5, until the rear end of the shank member 46 is locked in at the heel area.

The upward projecting heel margin portions 50 are then turned, or folded over, and heel-lasted to the shank member 46 by an appropriate shoe adhesive 51, as disclosed in FIG. 5.

The portion of the rim piece 29 projecting above the forepart insole 44 in FIG. 5 is folded over the bottom face of the forepart insole 44 and lasted in place, preferably by a suitable adhesive, as disclosed in FIG. 5.

When the forepart marginal area 52 is lasted, it should be pulled far enough over the forepart insole 44 that the bottom edge 32 of the vamp is in registry with the bottom edge of the forepart insole 44. The marginal area 52 is then skived or roughened for reception of the outsole 14.

Suitable adhesives are then applied to the roughened marginal area 52 and the bottom face of the insole 44, and an appropriately sized and shaped forepart or tap outsole 14 is secured in position against the insole 44, as shown in FIG. 6.

A heel 15 is then applied over the heel area 50 in any conventional manner, such as by adhesive or by nailing. The show 10 is then substantially completed, except for removal of the last 16, insertion of sock lining, application of appropriate finishing operations, and being packaged and shipped.

As best disclosed in FIGS. 2, 3 and 4, the rim portion 29 of the mudguard piece 13 is cut and stitched to the vamp 18 in such a manner that the rim portion depends at a pronounced angle to the vamp to form a forepart pocket recess for receiving the last 16 and insole 44 in a substantially contained position. After insertion of the last 16, the rim portion 29 does not float or tend to slide off the toe area of the last 16 in an uncontrolled manner, but is held in position against the toe of the last by the tension transmitted through the mudguard piece 13 from the shank flaps 41, in turn stitched to the quarters 21 and 22 and to each other by the line of stitching 42.

Furthermore, the formation of the oversized depending or projecting shank flaps 41 permits pre-stitching of these flaps along their abutting edges throughout the intermediate portion of the shoe, thereby forming a substantially pre-formed upper member pocket obtaining its substantial final shape when slip-lasted. Thus, the shoe only requires toe lasting and heel lasting with a minimum of effort, time, application of tension and alignment of the respective parts.

Moreover, the conventional outsole extending from the toe to the heel member is no longer required, because the arch or shank portion of the shoe is suitably covered by the stitched shank flaps 41 of the mudguard piece 13. Thus, only a forepart sole and a heel are required.

The shoe 10 also provides an attractive appearance, having a "mudguard" style or appearance by virtue of the mudguard piece 13 being cut into a relatively narrow forepart or rim portion 29 and the enlarged shank flaps 41, which in turn are stitched to the lower edge portion of the upper 12 above the insole 44. It will also be appreciated that the mudguard piece 13 may be of a different color from the upper 12, thereby providing a striking, decorative contrast in the entire upper member assembly 11.

What is claimed is:

1. In a shoe construction, a. an upper member comprising an upper and a discrete mudguard piece, said upper member having a forepart, an intermediate portion, and opposite sides, b. said upper having a forepart lower marginal portion, intermediate lower marginal portions on opposite sides, and a backpart portion, c. said mudguard piece having a top marginal portion extending throughout its forepart and intermediate sides, d. means securing the top marginal portion of said mudguard piece to the lower marginal portions of said upper, so that the secured forepart portions of said upper and said mudguard piece form a forepart pocket, e. at least one insole member having a bottom face within said upper member, f. said mudguard piece having spaced forepart bottom marginal portions secured to the bottom face to one of said insole members, g. the intermediate sides of said mudguard piece comprising side flaps having abutting bottom edges, h. means securing said abutting bottom edges together, i. a forepart outsole, j. means securing said forepart outsole to the forepart bottom marginal portions of said mudguard piece, and k. heel means fixed to the backpart portion of said upper.

2. The invention according to claim 1 in which said insole member comprises a forepart insole secured to said forepart bottom marginal portions and a backpart insole above the abutting bottom edges of said side flaps.

3. The invention according to claim 2 in which said backpart insole comprises an elongated rigid shank member.

4. The invention according to claim 1 in which the forepart and intermediate lower marginal portions of said upper underlap the top marginal portion of said mudguard piece, said forepart insole having a peripheral edge coextensive with and abutting the forepart lower marginal portion of said upper.

5. The invention according to claim 1 in which said mudguard piece has only said forepart and intermediate sides, means securing the back portions of said intermediate sides to the backpart portion of said upper.

* * * * *